US006637746B1

(12) United States Patent
Baranauskas

(10) Patent No.: US 6,637,746 B1
(45) Date of Patent: Oct. 28, 2003

(54) METHOD AND APPARATUS FOR PLAYING A WAGERING GAME

(76) Inventor: Alfons V. Baranauskas, 9956 Johnny Cake Rd., Unit M-10, Concord, OH (US) 44077

( * ) Notice: Subject to any disclaimer, the term of this patent is extended or adjusted under 35 U.S.C. 154(b) by 0 days.

(21) Appl. No.: 09/522,049

(22) Filed: Mar. 9, 2000

Related U.S. Application Data

(60) Provisional application No. 60/123,462, filed on Mar. 9, 1999, provisional application No. 60/123,460, filed on Mar. 9, 1999, provisional application No. 60/123,478, filed on Mar. 9, 1999, provisional application No. 60/123,466, filed on Mar. 9, 1999, provisional application No. 60/131,032, filed on Apr. 26, 1999, and provisional application No. 60/123,467, filed on Mar. 9, 1999.

(51) Int. Cl.[7] ..... A63F 1/00

(52) U.S. Cl. ..... 273/292; 273/303; 273/304; 273/306; 273/274

(58) Field of Search ..... 273/236, 292, 273/303, 274; 463/12, 13

(56) References Cited

U.S. PATENT DOCUMENTS

| | | | | | |
|---|---|---|---|---|---|
| 3,667,757 | A | | 6/1972 | Holmberg | |
| 4,817,528 | A | * | 4/1989 | Baker | 101/395 |
| 5,072,946 | A | | 12/1991 | Miller | |
| 5,098,107 | A | | 3/1992 | Boylan et al. | |
| 5,112,059 | A | * | 5/1992 | Mundle et al. | 273/292 |
| 5,174,579 | A | | 12/1992 | Griffiths | |
| 5,226,661 | A | | 7/1993 | Wolf | |
| 5,288,081 | A | | 2/1994 | Breeding | |
| 5,314,193 | A | | 5/1994 | Ferrer | |
| 5,324,041 | A | * | 6/1994 | Boylan et al. | 273/292 |
| 5,417,430 | A | * | 5/1995 | Breeding | 273/292 |
| 5,431,407 | A | * | 7/1995 | Hofberg et al. | 273/292 |
| 5,437,462 | A | * | 8/1995 | Breeding | 273/292 |
| 5,454,570 | A | | 10/1995 | Karal | |
| 5,496,038 | A | * | 3/1996 | Kangsanaraks | 273/292 |
| 5,529,309 | A | * | 6/1996 | Bartlett | 273/292 |
| 5,544,892 | A | * | 8/1996 | Breeding | 273/292 |
| 5,549,300 | A | * | 8/1996 | Sardarian | 273/292 |
| 5,713,573 | A | * | 2/1998 | Nazaryan | 273/292 |
| 5,713,574 | A | | 2/1998 | Hughes | |
| 5,720,484 | A | * | 2/1998 | Hsu | 273/292 |
| 5,743,530 | A | * | 4/1998 | Sklad et al. | 273/274 |
| 5,762,340 | A | * | 6/1998 | Feola | 273/292 |
| 5,772,211 | A | * | 6/1998 | Nazaryan et al. | 273/292 |
| 5,794,934 | A | * | 8/1998 | Malcolm | 273/292 |
| 5,803,809 | A | * | 9/1998 | Yoseloff | 463/13 |
| 5,813,673 | A | * | 9/1998 | Richardson | 273/292 |

(List continued on next page.)

OTHER PUBLICATIONS

Alfons V. Baranauskas; Triptease; Mar. 9, 1998 (effective date of copyright registration); TXu 843–395.

(List continued on next page.)

*Primary Examiner*—Benjamin H. Layno
*Assistant Examiner*—Dolores Collins
(74) *Attorney, Agent, or Firm*—Renner, Otto, Boisselle & Sklar, LLP

(57) ABSTRACT

A playing card wagering game method which involves each player placing an initial one part wager. Cards are dealt by a dealer, two cards face down to each participating player and three cards face down to the dealer display card area in front of the dealer position. Players examine their cards and must discard one of their two cards. Players decide to stand or double down on their initial wager. Dealer reveals one of the three dealer display area cards. Next players decide to challenge or to surrender one half of their total wagers. Dealer turns face up the remaining two cards in the dealer display card area and resolves all bets which were not withdrawn based on the winning card being of same color and same odd or even value as the match card. The present invention mat be played with the lower ranking portion, said portion comprising of card ranks Two through Eight of a standard deck of Poker playing cards or by video machine technology in a casino or home environment.

31 Claims, 7 Drawing Sheets

U.S. PATENT DOCUMENTS

| | | | | | |
|---|---|---|---|---|---|
| 5,845,906 | A | * | 12/1998 | Wirth | 273/274 |
| 5,845,907 | A | * | 12/1998 | Wells | 273/292 |
| 5,851,011 | A | * | 12/1998 | Lott | 273/292 |
| 5,895,047 | A | * | 4/1999 | Callahan | 273/292 |
| 5,911,419 | A | | 6/1999 | Delaney et al. | |
| 5,957,459 | A | * | 9/1999 | Chae | 273/292 |
| 5,975,529 | A | * | 11/1999 | De Keller | 273/292 |
| 5,988,643 | A | * | 11/1999 | Awada | 273/292 |
| 6,019,374 | A | * | 2/2000 | Breeding | 273/292 |
| 6,029,976 | A | * | 2/2000 | Brunelle | 273/309 |
| 6,042,118 | A | * | 3/2000 | Poitra | 273/292 |
| 6,065,753 | A | | 5/2000 | Morosky | |
| 6,070,873 | A | * | 6/2000 | Perkins | 273/292 |
| 6,073,930 | A | * | 6/2000 | Jones et al. | 273/292 |
| 6,079,713 | A | | 6/2000 | Paz | |
| 6,095,525 | A | * | 8/2000 | Terminel | 273/274 |
| 6,098,984 | A | * | 8/2000 | Moore, Jr. | 273/292 |
| 6,113,101 | A | * | 9/2000 | Wirth | 273/274 |
| 6,189,888 | B1 | * | 2/2001 | Brunelle | 273/292 |
| 6,196,548 | B1 | * | 3/2001 | Schaefer | 273/292 |
| 6,206,373 | B1 | * | 3/2001 | Garrod | 273/292 |
| 6,206,375 | B1 | * | 3/2001 | Wichinsky | 273/292 |
| 6,234,483 | B1 | * | 5/2001 | Bucan | 273/292 |
| 6,234,485 | B1 | * | 5/2001 | Perkins | 273/292 |
| 6,237,916 | B1 | * | 5/2001 | Webb | 273/292 |
| 6,237,917 | B1 | * | 5/2001 | Timpano | 273/292 |
| 6,241,250 | B1 | * | 6/2001 | Webb | 273/292 |
| 6,247,697 | B1 | * | 6/2001 | Jewett | 273/292 |
| 6,264,200 | B1 | * | 7/2001 | Smith | 273/274 |
| 6,273,424 | B1 | * | 8/2001 | Breeding | 273/292 |
| 6,279,910 | B1 | | 8/2001 | de Keller | |

OTHER PUBLICATIONS

Alfons V. Baranauskas; Forty–Niner; Mar. 9, 1998 (effective date of copyright registration); TXu 843–393.

Alfons V. Baranauskas; Wagering Card Game; Mar. 9, 1998 (effective date of copyright registration); TXu 843–411.

Alfons V. Baranauskas; On the Money; Mar. 9, 1998 (effective date of copyright registration); TXu 848–200.

Alfons V. Baranauskas; Birdie; Mar. 9, 1998 (effective date of copyright registration); TXu 843–394.

Alfons V. Baranauskas; TRIO; Jul. 15, 1999 (date received by Copyright Office).

Alfons V. Baranauskas; Match; Jul. 15, 1999 (date received by Copyright Office).

Alfons V. Baranauskas; Midway; Jul. 15, 1999 (date received by Copyright Office).

Alfons V. Baranauskas; Split; Jul. 15, 1999 (date received by Copyright Office).

Alfons V. Baranauskas; Niner; Jul. 15, 1999 (date received by Copyright Office).

* cited by examiner (CARDS NOT SHOWN)

(CARDS SHOWN)

METHOD AND APPARATUS FOR PLAYING A WAGERING GAME

CLAIM OF PRIORITY

This application claims priority based on provisional patent applications Ser. No. 60/123,462, filed Mar. 9,1999; Ser. No. 60/123,460, filed Mar. 9, 1999; Ser. No. 60/123,478, filed Mar. 9,1999; Ser. No. 60/123,466, filed Mar. 9, 1999; Ser. No. 60/131,032, filed Apr. 26, 1999; and Ser. No. 60/123,467, filed Mar. 9,1999. All of the aforesaid applications are hereby incorporated herein by reference.

TECHNICAL FIELD

The present invention relates to a playing card wagering game that can be played with the lower numerical ranking portion comprising the card ranks of Two through Eight of a typical fifty-two card Poker deck or by video machine technology in a casino or home environment. In particular, it does relate to a method and apparatus for playing a wagering game wherein the game is not a variation of typical Poker game play and provides players with a game that is uncomplicated and exciting and one that can be played by a large number of players.

BACKGROUND

There are many wagering games used for betting or chancing. Such games should be exciting to arouse players interest and uncomplicated so they can be easily understood by a large quantity of players. Ideally the game should offer more than one wagering opportunity during the course of the game, and yet also should be able to be played swiftly to a wager resolving outcome. Wagering games particularly those intended primarily for play in casinos should provide players with a sense of control and the opportunity to make more than one card drawing decision and reasonable odds of winning although the odds favor the house. The game must also accommodate the requirements of the regulatory agencies.

SUMMARY OF THE PRESENT INVENTION

The wagering game of the present invention may be played with the lower ranking cards or portion of a typical fifty-two card Poker deck or a conglomeration of multiple said cards, said portion comprising the card ranks of Two through Eight. Card ranks of Nine through Ace need not be used in the present invention. Said game does not involve the generally well recognized and accepted set of rules and procedures of typical Poker game play. The game method comprises of each player placing a one part wager to participate in the game. Cards are dealt by a dealer. Two cards are dealt face down to each player and three cards face down are dealt to a dealer display card area. Players examine their two cards and then must make a mandatory decision of discarding one of their two cards. Next players have the decision option of increasing their wager, for example, by doubling down said wager. Dealer then turns one card face up of the three cards in the dealer display card area. Players then have the decision option of keeping their one card hand or said player can surrender said hand by forfeiting part of their total wager. Dealer then turns the remaining two cards in the dealer display card area face up. The dealer uses a method unique in the present invention for calculating which one of the three dealer display area cards will be the single match card for each participating player to match their held card against. Said match is based on two values given to all cards used in the present invention. Players are not playing against each other or against the dealer. Finally players show or reveal their one card hand and all remaining bets are resolved.

According to an embodiment of the present invention, each player places an initial one part wager to participate in the game before any cards are dealt by the dealer. A dealer display card area is dealt the first card and this card is dealt face down. Next each player is dealt two cards face down in the customary fashion and two more cards are dealt face down to the dealer display card area in the same said fashion. Said display card areas cards are potential match cards for use by each participating player. After all players have placed their bets and received and examined their cards, each player is given a mandatory decision choice of discarding one of their two initial cards and placing said card into a discard area in front of that player position on the gaming table top. Next participating players are queried by the dealer that they have a decision option of making a double down wager by betting an amount equal to their initial wager and placing it next to said wager. The dealer then turns face up the first card of the three dealer display area cards. Next players are queried by the dealer that they can continue their hand or that they have a decision option of surrendering their one card hand. Participating players who choose to surrender said hand can by forfeiting one half of their total wagers and retrieving the remainder one half wager. Surrendered hands are considered dead cards, said cards and one half of said hands wagers are collected by the dealer. Next the dealer turns face up and reveals the remaining two face down cards in the dealer display card area. The dealer then performs a simple and fair calculation based on isolating the odd colored card of the three dealer display area cards and places said card into the single match card area in front of the dealer position. If all three dealer display area cards are of the same color, then all three said cards remain face up in the dealer display card area in front of the dealer position. All cards in the players hand and in the dealer displays card area are given an odd or even value prior to the game start based on the numerical rank value of said cards; i.e. Card ranks of two, four, six and eight are given the typical value of even and card ranks of three, five and seven are given the typical value of odd. The dealer isolates the odd colored card of the three dealer display area cards. For example, if the three dealer display area cards are of one black card and of two red cards then the black card is considered the odd color card and said card is isolated and dealer places said card face up into the single match card area. Next the dealer verbally announces the color of red or black and odd or even value of said card in the single match card area to be matched by each participating players one card hand. Each players card must match in same color of either red or black and simultaneously said players card must match in same either odd or even value to qualify as a winning match card. The players show their cards and the dealer examines each of the players hands and determines what payout, if any, each player is entitled to receive according to that players one card hand and said players total wager. Payouts are made to players with winning hands and the losing hands wagers are collected by the dealer. If remaining unused cards are not sufficient in number to complete the next hand, the cards are reshuffled.

According to another embodiment of the present invention, after all players have placed their bets and received and examined their cards, each player is given a mandatory decision choice of keeping one card and discarding one card of their two initial cards and placing said cards into respective match card and discard areas in front of that player position on the gaming table top.

Apparatus is disclosed for playing the wagering game according to the method outlined above. A typical gaming table with a playing surface is modified to include specific areas that provide locations for receiving the players wagers and an area for receiving and displaying the players discards, an area for receiving and displaying the players cards, an area for receiving the three cards in the dealer display card area, and an area for receiving and displaying the 20 single match card. A card shuffling machine such as that disclosed in U.S. Pat. No. 4,807,884 for facilitating and speeding the play of the wagering game may be used but is not necessary in the present invention.

It is an aim of the present invention to provide an exciting and a new approach to the wagering game industry by detouring from the typical Poker game variations.

It is an aim of the present invention to provide opportunity for easy and strategic play along with skill opportunity.

It is another aim of the present invention to provide opportunity for players to make decisions by said players being given the chance to make more than one wager or bet per hand.

It is another aim of the present invention to provide a unique and simple card game for play in casinos or at home and on various media including casino tables and or video machines.

It is also an aim of the present invention to provide a new game and not a variation of two well known single card wagering games such as Guts or Red Dog.

It is an advantage of the game of the present invention that discarding decisions along with surrender choices are inherent to the game. The game enhances the players sense of participation and takes advantage of players inclination to change their decisions, thereby providing an opportunity for the house to gain or profit due to player error.

DESCRIPTION OF THE DIAGRAMS

DETAILED DESCRIPTION OF THE PREFERRED EMBODIMENT

Figure 1:
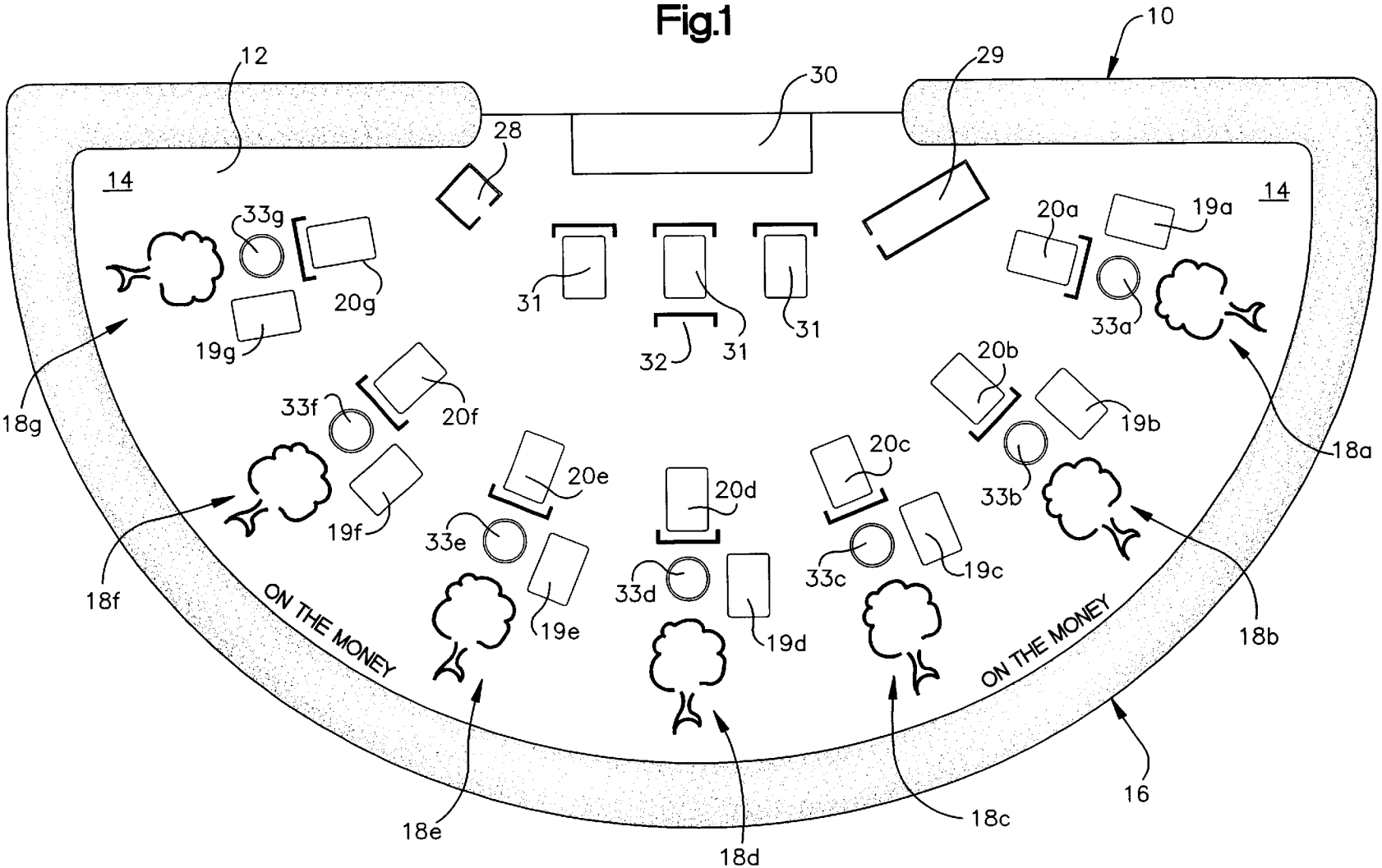
FIG. 1 depicts a table top layout and apparatus used in playing a wagering game in accordance with an embodiment of the present invention.

Referring to FIG. 1, an apparatus for the wagering game of the present invention includes a typical casino gaming, half sphere in geometric shape table 12. The table 12 has a curved side 16 for accommodating up to seven players and a straight side 10 for accommodating the dealer. The table 12 has a flat surface 14 covered with cloth, felt or other appropriate material. Although seven player positions or locations 18*a–g* (each being depicted by a single tree or other appropriate image) for individual players are provided, it is not essential to the game that exactly seven persons play. For professional or casino play a maximum of seven players provides for a game that is easily manageable by the dealer or house. A house dealer position 30 including an area suitable for displaying a single match card 32 and an area for displaying three dealer display card areas 31 are provided. Each of the player positions 18*a–g* includes a wagering area 33*a–g*. Also said player positions 18*a–g* include a discard area 20*a–g* for receiving one discard from each participating players initial two cards. Each player position 18*a–g* includes a customary non specific card area 19*a–g* next to said player's 18*a–g* wager area 33*a–g* for receiving and displaying a players one card hand, said card is placed there by the player occupying that position. The wagering areas 33*a–g* are designed to receive appropriate wagering settling means such as coins or chips (not shown). At one side of the dealer position 30, an apparatus for containing the conglomeration of hand shuffled cards rests unmounted on the table top 14 and is commonly referred to as a card shoe 29. The card shoe 29 is loaded or filled with said cards by the dealer. Said apparatus is of a typical open ended box for dispensing cards face down. At one side of the dealer position 30 is an apparatus for receiving and accumulating the used cards during game play and said may be of a raised three wall type open ended plastic box 28. Said apparatus'12, 28 and 29 are provided by the casino or house.

Figure 2:
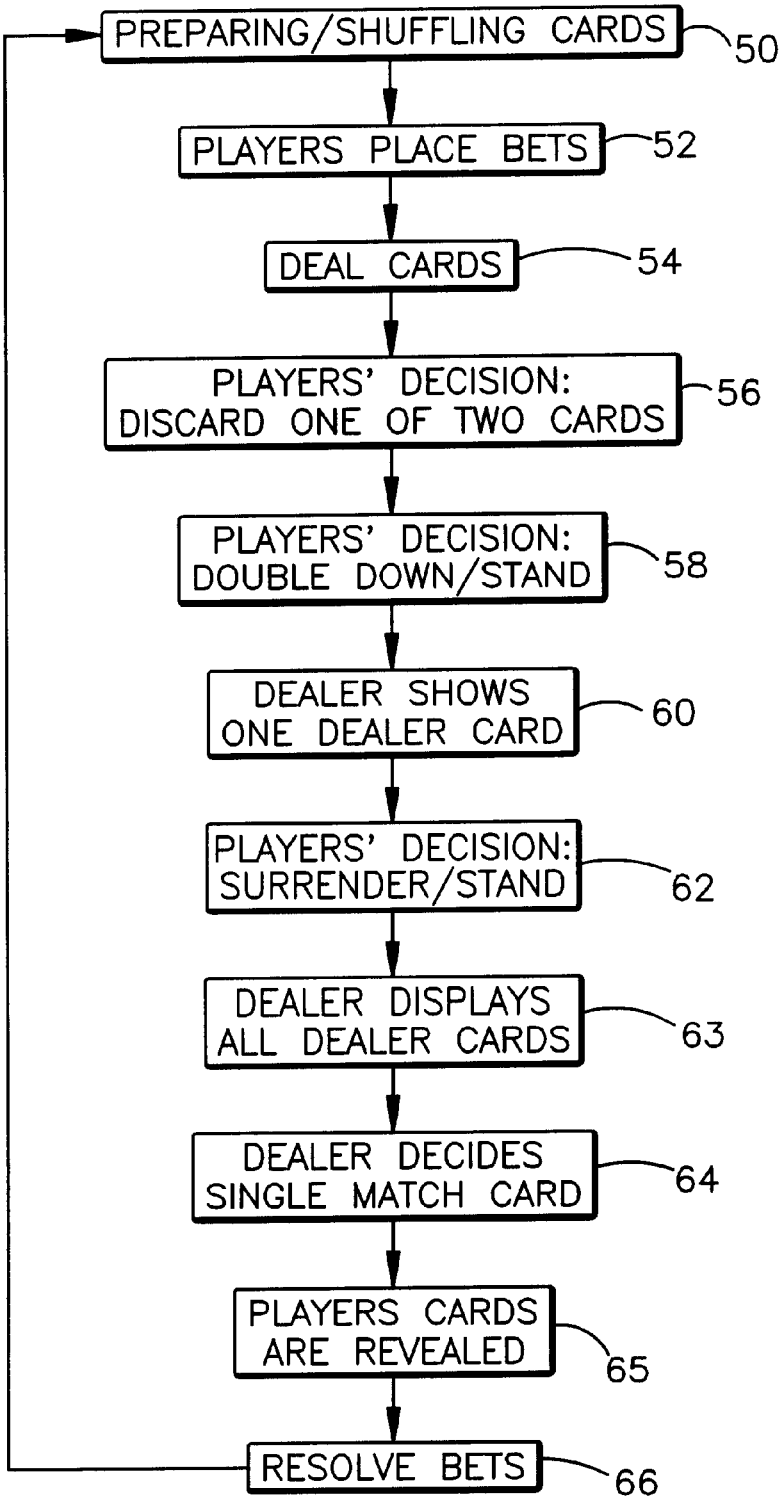
FIG. 2 is a Flow diagram representing the flow of play in said FIG. 1 game.

Referring to the Flow diagram of FIG. 2, the initial step in playing the game of the present invention is preparing and shuffling the lower numerical ranking portion of a typical Poker deck or conglomeration of multiple said portions Flow 50, the portion comprising the card ranks of Two through Eight. The card ranks of Nine through Ace are isolated then discarded and need not be used in the present invention. Hand shuffling by the dealer is used to provide the shuffled cards. Next the participating players place their initial wagers Flow 52 into the appropriate wagering area 33*a–g* for that player position. After participating players place their wagers, the cards are dealt by a dealer Flow 54. The dealer deals two cards face down to each player and deals three cards face down to the dealer display card area. Of course, the order in which the cards are initially dealt may differ as desired. For example, cards may be dealt to the players first and then to the dealer, or the cards may be dealt to the dealer first and then to the players. Also, the cards may be dealt at one at a time in succession to each player and the dealer or in groups to each player and the dealer. Of course other variations in the way the cards are dealt Flow 54 are also possible and such variations are contemplated as falling within the scope of the claimed invention. The players inspect their cards in preparation for reaching decision Flow 56. At decision Flow 56, each participating player must discard one of their two cards and place said card into the appropriate player discard area 20*a–g*, and said player places the remaining held card into the appropriate card area 19*a–g* next to their respective wager area 33*a–g* for that player position 18*a–g*. Each player makes this discard decision on a strategic match card basis which is inherent to the present invention. Players prepare to reach decision Flow 58. At decision Flow 58, players are queried by the dealer that each player can bet an additional wager amount, said wager being, for example, a double down bet (i.e., equal in value to that players initial wager), and placed next to said initial wager. Next the dealer turns face up one of the three face down cards 31 in the dealer display card area Flow 60. Each player prepares for decision Flow 62. During decision Flow 62 each player 18*a–g* decides if they will surrender their hand 19*a–g* by forfeiting a portion of their total wagers 33*a–g* (for example, one half and retrieving the remainder (for example, one half, or the players can refuse to surrender and proceed to Flow 63. The players decision is on the basis of what card the dealer turned face up at Flow 60. Surrendered hands are considered dead hands and have no further obligation. The cards and partial wagers from said surrendered hands are collected by the dealer. The dealer turns face up the remaining two cards in the dealer display card area Flow 63 for each player to view. The dealer then performs a non complex method as in a fair calculation based on isolating the odd colored card of the three dealer display area cards which will qualify as a single match card. Dealer then places said isolated odd colored card into the single match card position 32 in front of the dealer position 30. If all three dealer display area cards 31 are of the same color, then all said cards remain in the dealer display card area 31 and all said three cards qualify as match cards for each player to match in color of red or black and odd or even value. The dealer then decides which one card of said three cards is to be a single match card for the players at Flow 64 according to the house or casino policies and places the single match card into the single match card position 32. Flow of the game proceeds to Flow 65. At Flow 65 each participating players hand is revealed and the dealer prepares to resolve said players wagers, wherein all players held card 19*a–g* during Flow 56 that matches the single match card in position 32, in same color of red or black and same odd or even value given to said cards numerical value are considered winning hands. Next the dealer resolves each players bet Flow 66 based on which players held card has the same match in said colors of either red or black and same said odd or even value as the single match card in position 32 and said dealer then determines what payout, if any, the player is entitled to receive according to, for example, one for one or even money odds. Bets on non winning hands are collected by the dealer or house. The hand is then over and the flow of the game returns to Flow 52, players place bets. If the remaining unused cards are exhausted to an unplayable level, the flow of the game then returns to Flow 50, preparing and shuffling cards.

Figure 3:
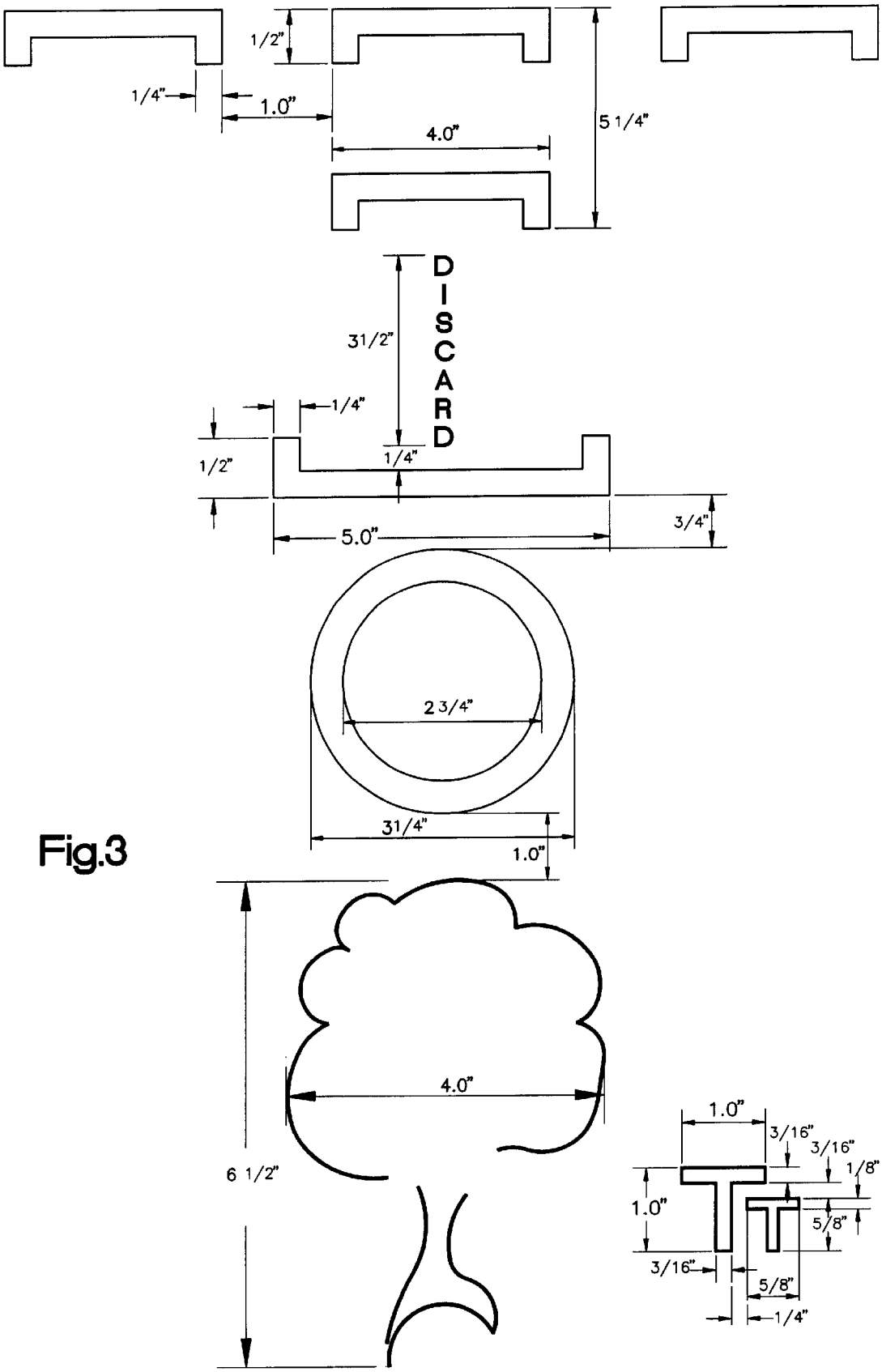
FIG. 3 depicts the actual dimensions of specific areas on a gaming table top in accordance with the present invention and for use in said FIG. 1 game.

Referring to FIG. 3, this is a diagram wherein the tabletop positions for the players positions and wager areas, said card areas, the author of the present inventions abbreviated company name "TABLETOP TECHNOLOGY"(TT), the dealers display card area and the single match card area are depicted in a two-dimensional view.

Figure 4:
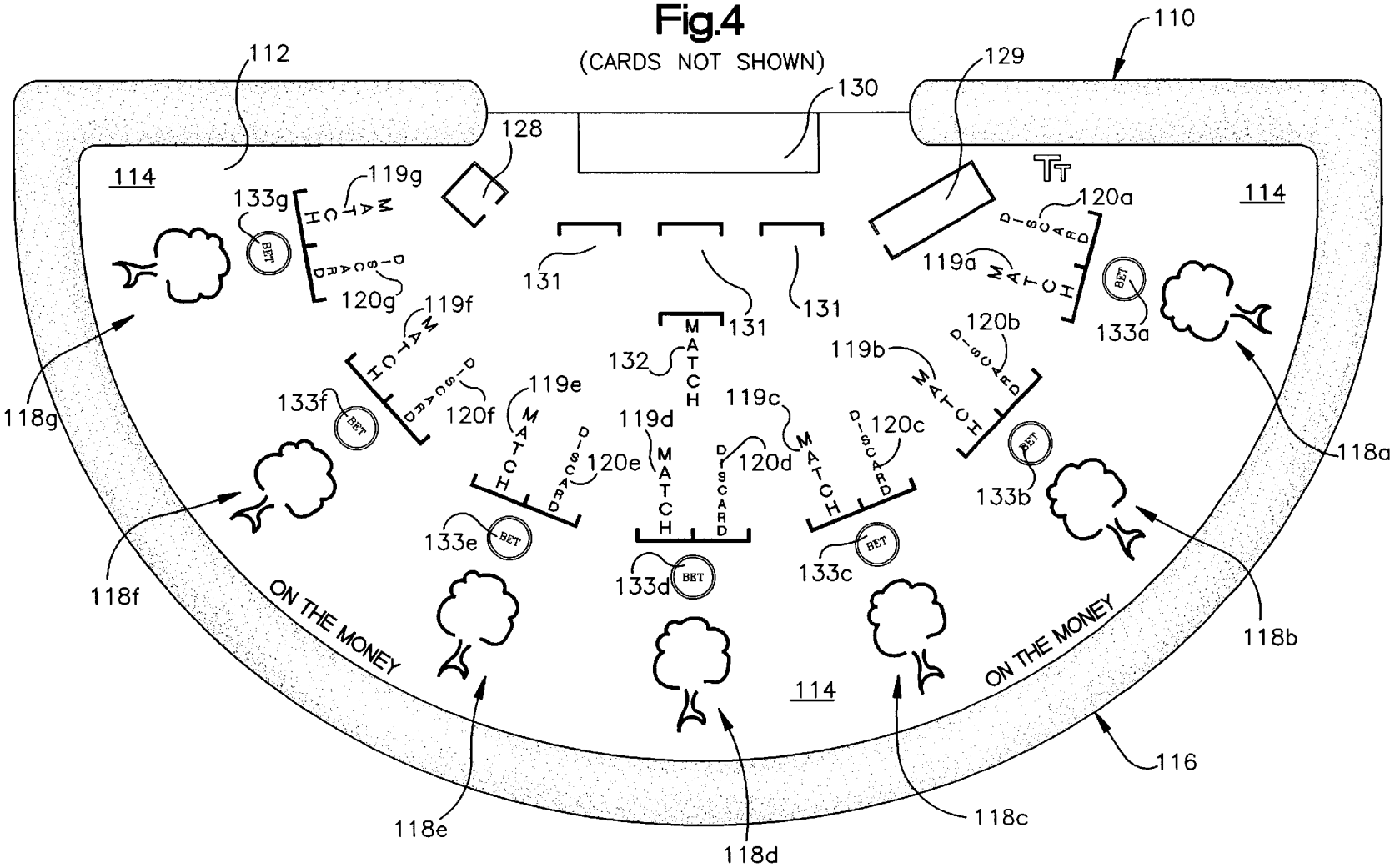
FIG. 4 depicts a table top layout and apparatus used in playing a wagering game in accordance with another embodiment of the present invention wherein cards are not shown.
Figure 5:
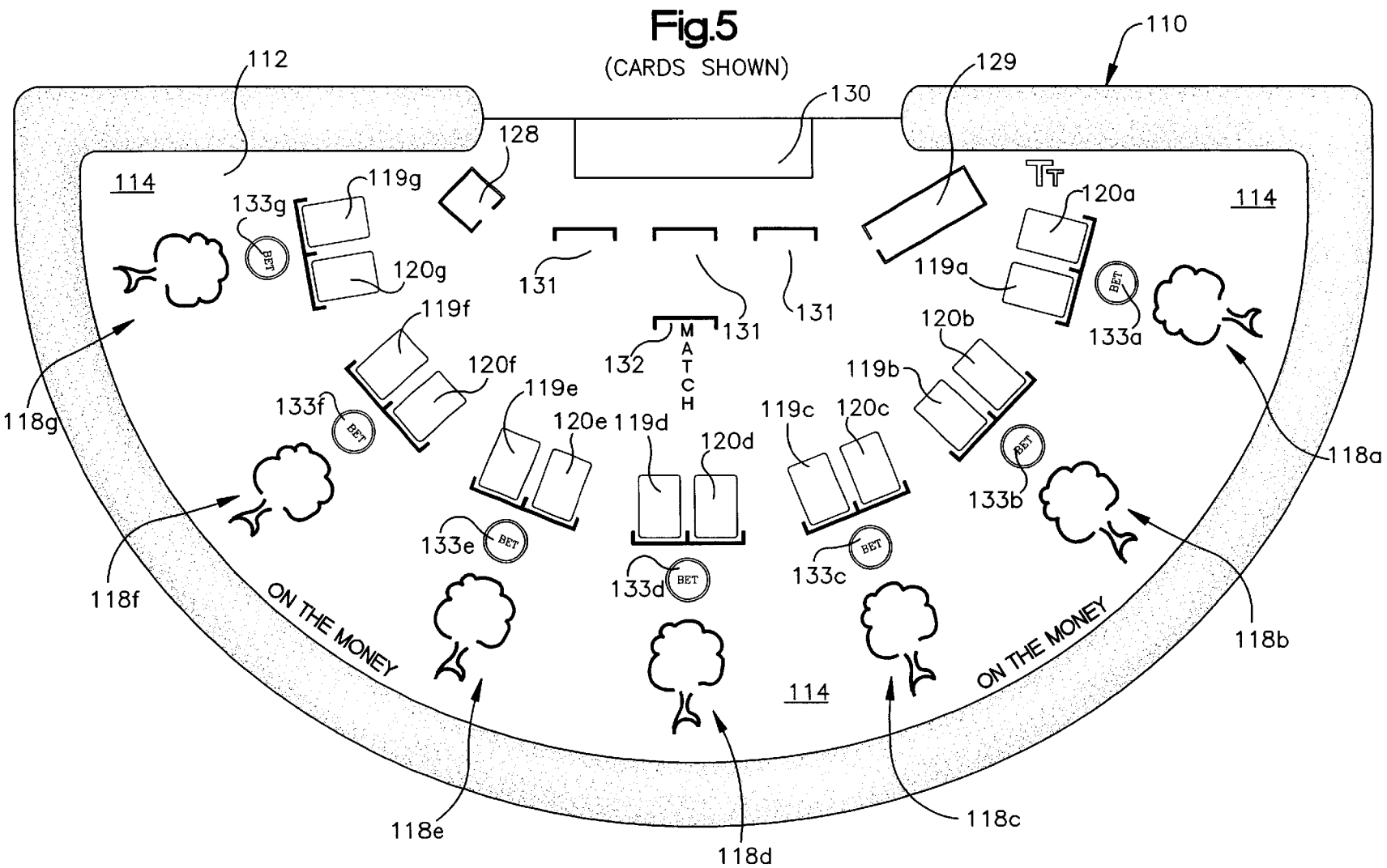
FIG. 5 depicts the table top layout and apparatus used in playing the wagering game depicted in FIG. 4 wherein cards are shown.

Referring now to FIGS. 4 and 5, an apparatus for the wagering game of the present invention includes a typical casino gaming, half sphere in geometric shape table 112. FIG. 4 shows the table wherein cards are not shown and FIG. 5 shows the table wherein cards are shown. The table 112 has a curved side 116 for accommodating up to seven players and a straight side 110 for accommodating the dealer. The table 112 has a flat surface 114 covered with cloth, felt or other appropriate material. Although seven player positions or locations 118*a–g* (each being depicted by a single tree or other appropriate image) for individual players are provided, it is not essential to the game that exactly seven persons play. For professional or casino play a maximum of seven players provides for a game that is easily manageable by the dealer or house. A house dealer position 130 including an area suitable for displaying a single match card 132 and an area for displaying three dealer display card areas 131 are provided. Each of the player positions 118*a–g* includes a wagering area 133*a–g*. Also said player positions 118*a–g* include a discard area 120*a–g* for receiving one discard from each participating players initial two cards. Each player position 118*a–g* includes a specific match card area 119*a–g* next to said player's discard area 120*a–g* for receiving and displaying a players one card hand, said card is placed there by the player occupying that position. The wagering areas 133*a–g* are designed to receive appropriate wagering settling means such as coins or chips (not shown). At one side of the dealer position 130, an apparatus for containing the conglomeration of hand shuffled cards rests unmounted on the table top 114 and is commonly referred to as a card shoe 129. The card shoe 129 is loaded or filled with said cards by the dealer. Said apparatus is of a typical open ended box for dispensing cards face down. At one side of the dealer position 130 is an apparatus for receiving and accumulating the used cards during game play and said may be of a raised three wall type open ended plastic box 128. Said apparatus'112, 128 and 129 are provided by the casino or house.

Figure 6:
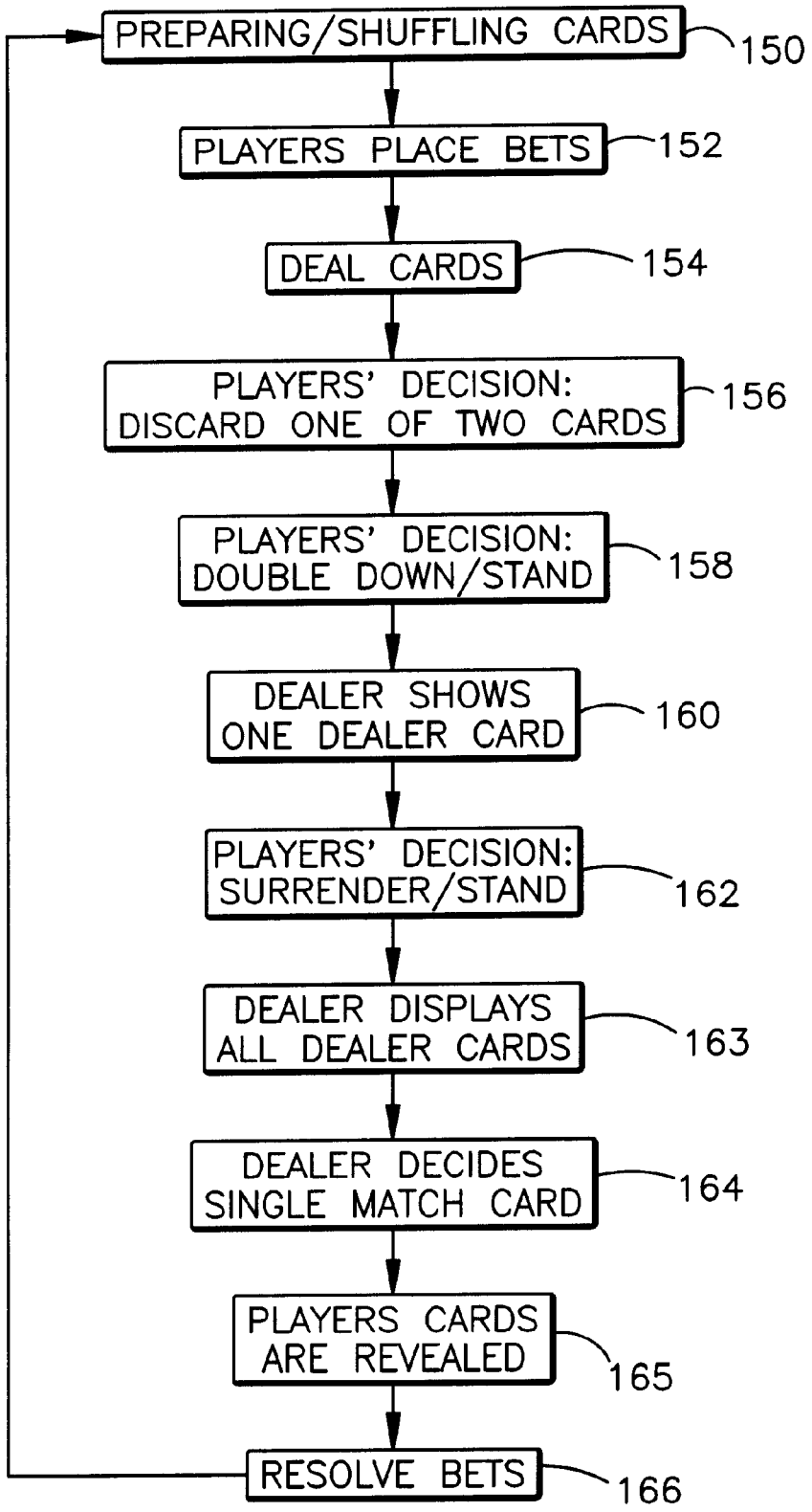
FIG. 6 is a Flow diagram representing the flow of play in said FIG. 4 game.

Referring to the Flow diagram of FIG. 6, the initial step in playing the game of the present invention is preparing and shuffling the lower numerical ranking portion of a typical Poker deck or conglomeration of multiple said portions Flow 150, the portion comprising the card ranks of Two through Eight. The card ranks of Nine through Ace are isolated then discarded and need not be used in the present invention. Hand shuffling by the dealer is used to provide the shuffled cards. Next the participating players place their initial wagers Flow 152 into the appropriate wagering area 133*a–g* for that player position. After participating a players place their wagers, the cards are dealt by a dealer Flow 154. The dealer deals two cards face down to each player and deals three cards face down to the dealer display card area. Of course, the order in which the cards are initially dealt may differ as desired. For example, cards may be dealt to the players first and then to the dealer, or the cards may be dealt to the dealer first and then to the players. Also, the cards may be dealt at one at a time in succession to each player and the dealer or in groups to each player and the dealer. Of course other variations in the way the cards are dealt Flow 154 are also possible and such variations are contemplated as falling within the scope of the claimed invention. The players inspect their cards in preparation for reaching decision Flow 156. At decision Flow 156, each participating player must discard one of their two cards and place said card into the appropriate player discard area 120*a–g*, and said player places the remaining held card into the appropriate match card area 119*a–g* near their respective wager area 133*a–g* for that player position 118*a–g*. Each player makes this discard decision on a strategic match card basis which is inherent to the present invention. Players prepare to reach decision Flow 158. At decision Flow 158, players are queried by the dealer that each player can bet an additional wager amount, said wager being, for example, a double down bet (i.e., equal in value to that players initial wager), and placed next to said initial wager. Next the dealer turns face up one of the three face down cards 131 in the dealer display card area Flow 160. Each player prepares for decision Flow 162. During decision Flow 162 each player 118*a–g* decides if they will surrender their hand 119*a–g* by forfeiting a portion of their total wagers 133*a–g* (for example, one half and retrieving the remainder (for example, one half, or the players can refuse to surrender and proceed to Flow 163. This players decision is on the basis of what card the dealer turned face up at Flow 160. Surrendered hands are considered dead hands and have no further obligation. The cards and partial wagers from said surrendered hands are collected by the dealer. The dealer turns face up the remaining two cards in the dealer display card area Flow 163 for each player to view. The dealer then performs a non complex method as in a fair calculation based on isolating the odd colored card of the three dealer display area cards which will qualify as a single match card. Dealer then places said isolated odd colored card into the single match card position 132 in front of the dealer position 130. If all three dealer display area cards 131 are of the same color, then all said cards remain in the dealer display card area 131 and all said three cards qualify as match cards for each player to match in color of red or black and odd or even value. The dealer then decides which one card of said three cards is to be a single match card for the players at Flow 164 according to the house or casino policies and places the single match card into the single match card position 132. Flow of the game proceeds to Flow 165. At Flow 165 each participating players hand is revealed and the dealer prepares to resolve said players wagers, wherein all players held card 119*a–g* during Flow 156 that matches the single match card in position 132, in same color of red or black and same odd or even value given to said cards numerical value are considered winning hands. Next the dealer resolves each players bet Flow 166 based on which players held card has the same match in said colors of either red or black and same said odd or even value as the single match card in position 132 and said dealer then determines what payout, if any, the player is entitled to receive according to, for example, one for one or even money odds. Bets on non winning hands are collected by the dealer or house. The hand is then over and the flow of the game returns to Flow 152, players place bets. If the remaining unused cards are exhausted to an unplayable level, the flow of the game then returns to Flow 150, preparing and shuffling cards.

Figure 7:
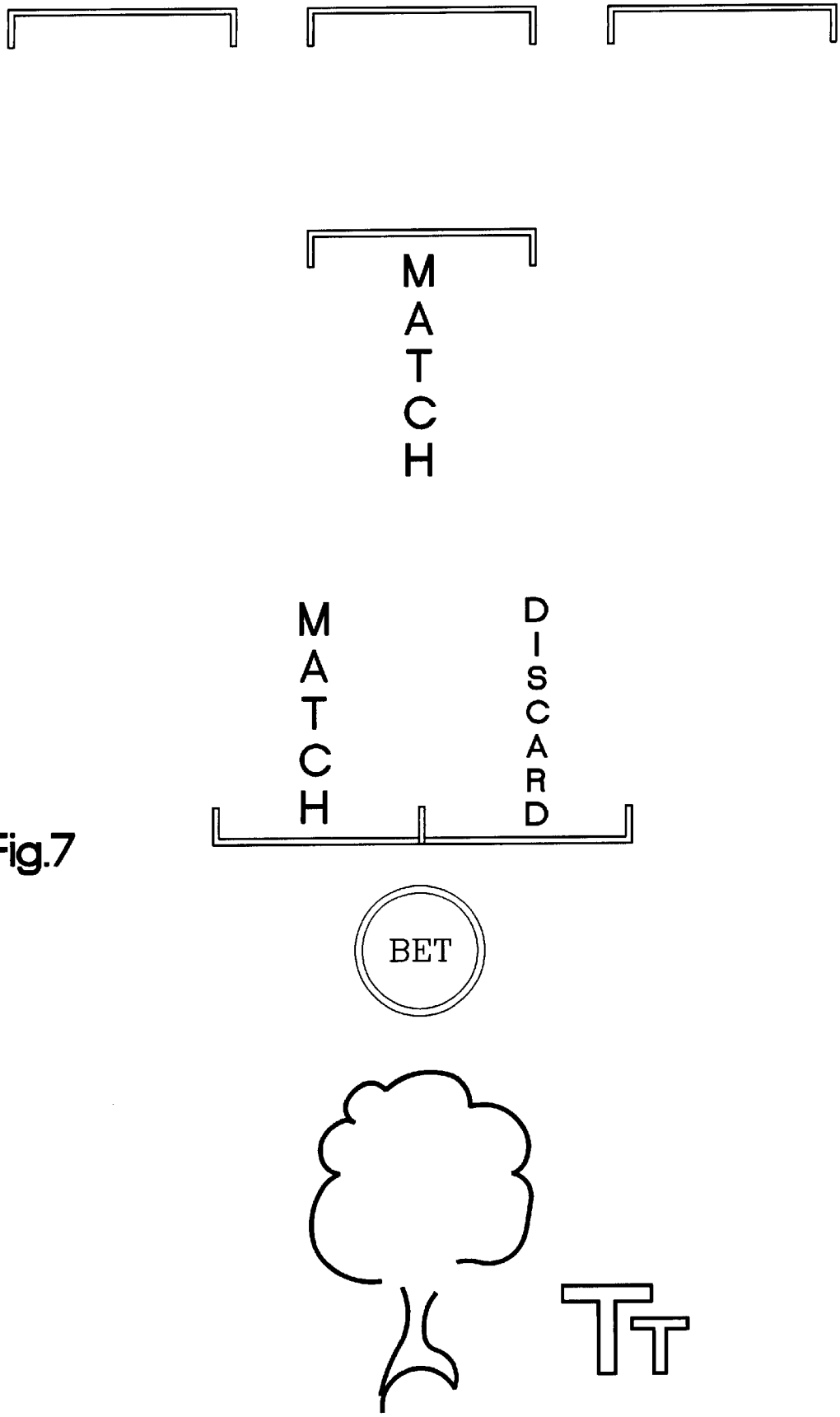
FIG. 7 depicts the actual dimensions of specific areas on a gaming table top in accordance with the present invention and for use in said FIG. 4 game.

Referring to FIG. 7, this is a diagram wherein the tabletop positions for the players positions and wager areas, said match card and said discard card areas, the author of the present inventions abbreviated company name "TABLETOP TECHNOLOGY"(TT), the dealers display card area and the single match card area are depicted in a two-dimensional view.

The wagering game of the present invention might be played live in casinos with a house dealer or homes in interactive electronic or video form with automatic coin or betting machines with payout capabilities. The present invention may also be embodied in other specific forms without departing from the essential attributes thereof. It is desired that the embodiments described above may be considered in all respects as illustrative and not restrictive, reference being made to the appended claims.

According to an aspect of the invention, there is provided a method of playing a wagering card game for a number of players, comprising the steps of: providing a plurality of lower numerical ranking cards of one or more typical fifty-two card Poker decks, at least two of the cards having different values; each player placing a wager to participate in the game; dealing at least two cards to each player and at least three cards to a dealer display card area; giving each player an opportunity to examine the cards received by that player; each player discarding at least one and holding at least one of their respective at least two dealt cards; revealing the at least three dealt cards in the dealer display card area and selecting a single dealer match card from said revealed three cards; resolving each players wager based on whether the players hold card matches the dealers single match card.

In an embodiment of the invention, after revealing at least ode of the at least three dealt cards in the dealer display card area, giving each player an option to reduce their respective wager.

In an embodiment of the invention, if after revealing the at least three dealt cards in the dealer display card area there are remaining cards in the dealer display card area, then revealing the remaining cards in the dealer display card area.

In an embodiment of the invention, selecting the single dealer match card comprises selecting a card from the at least three dealt cards in the dealer display card area that differs in value from the remaining cards.

According to an aspect of the invention, there is provided a method of playing a wagering card game for a number of players, comprising the steps of: providing a plurality of lower numerical ranking cards of one or more typical fifty-two card Poker decks, at least two of the cards having different color values; each player placing an initial wager to participate in the game; a dealer dealing two cards to each player and three cards to a dealer display card area; giving each player an opportunity to examine the two cards received by that player; each player discarding one card and holding one card of the two cards received by the respective player; giving each player an option to increase their respective initial wager; revealing one card of the three cards in the dealer display card area; giving each player an option to forfeit a part of their initial wager; revealing the remaining cards in the dealer display card area; and resolving each players wager which was not forfeited based on the color value of that players hold card and the color value of the cards in the dealer display card area.

In an embodiment of the invention, a players two dealt cards are both winning match cards by same color value of red or black.

In an embodiment of the invention, a players two dealt cards are both winning match cards by same odd or even value given to said cards numerical rank.

According to an aspect of the invention, there is provided a method of playing a wagering card game for a number of players, comprising the steps of: providing a plurality of lower numerical ranking cards of one or more typical fifty-two card Poker decks, at least two of the cards having different color values; each player placing an initial wager to participate in the game; dealing two cards face down to each player and three cards face down to a dealer display card area; giving each player an opportunity to examine their initial two cards received by that player; each player discarding one card and holding one card of the two cards received by the respective player; giving each player an option to increase their initial wager by allowing said players to bet an additional amount equal to said wager; revealing a first card of the three cards dealt in the dealer display card area then giving each player an opportunity to withdraw one half of their wager and forfeit the remaining one half of said wager; revealing the remaining two cards in the dealer display card area; isolating an odd colored card of the three cards in the dealer display card area, said isolated card constituting a single match card; and resolving each players total wager which was not forfeited or withdrawn based on the red or black color and odd or even value of that players held card matching the color and said value of the single match card the dealer isolated from the dealer display card area.

In an embodiment of the invention, a winning card matches in same color all three of the cards in the dealer display card area.

In an embodiment of the invention, a winning card matches in same odd or even value all three of the cards in the dealer display card area.

What is claimed is:

1. A method of playing a wagering card game for a number of players, comprising the steps of:

providing a plurality of lower numerical ranking cards of one or more typical fifty-two card Poker decks, the cards having associated even or odd values, and at least two of the cards having different associated values;

each player placing a wager to participate in the game;

dealing at least two cards to each player and at least three cards to a dealer display card area;

giving each player an opportunity to examine the cards received by that player;

each player discarding at least one and holding at least one of their respective at least two dealt cards;

revealing the at least three dealt cards in the dealer display card area and selecting a single dealer match card from said revealed cards;

resolving each players wager based on whether the associated color value and even or odd value of the players hold card matches the associated color value and even or odd value of the dealers single match card.

2. The method according to claim 1, wherein the plurality of lower numerical ranking cards of one or more typical fifty-two card Poker decks comprises the cards having the rank of two through eight.

3. The method according to claim 1, wherein the at least two cards dealt to the player comprises two cards.

4. The method according to claim 1, wherein the at least three cards dealt to the dealer display card area comprises three cards.

5. The method according to claim 1, wherein after the step of each player discarding at least one of their respective at least two dealt cards, giving each player an option to change their wager.

6. The method according to claim 5, wherein changing the players wager comprises doubling the players wager.

7. The method according to claim 1, wherein said at least two of the cards have different color values comprises at least one of the cards having a red color value and one of the cards having a black color value.

8. The method according to claim 1, wherein after revealing at least one of the at least three dealt cards in the dealer display card area, giving each player an option to reduce their respective wager.

9. The method according to claim 1, wherein before revealing the at least three cards dealt in the dealer display card area, revealing one card dealt in the dealer display card area and giving each player an option to surrender from the game.

10. The method according to claim 9, wherein if a player opts to surrender from the game then at least a portion of that players wager is forfeited.

11. The method according to claim 1, wherein if after revealing the at least three dealt cards in the dealer display card area there are remaining cards in the dealer display card area, then revealing the remaining cards in the dealer display card area.

12. The method according to claim 1, wherein selecting the single dealer match card comprises selecting a card from the at least three dealt cards in the dealer display card area that differs in color value from the remaining cards.

13. The method according to claim 1, wherein the at least three cards dealt in the dealer display card area comprises three dealer match cards and the step of identifying the single match card comprises identifying a single card of the three dealer match cards that has a different color value from that of the two remaining dealer match cards.

14. The method according to claim 1, wherein the at least three cards dealt to the dealer display card area comprises three dealer match cards and the step of identifying the single match card comprises identifying a single card of the three dealer match cards according to a prescribed dealer policy.

15. The method according to claim 1, wherein a winning wager comprises a players hold card having the same color and same odd or even numerical value as that of the dealers single match card.

16. The method according to claim 1, wherein the odd value cards comprise any of cards three, five or seven.

17. The method according to claim 1, wherein the even value cards comprise any of cards two, four, six or eight.

18. The method according to claim 1, wherein the quantity of players decisions is equal to the quantity of cards each player discards.

19. A method of playing a wagering card game for a number of players, comprising the steps of:

providing a plurality of lower numerical ranking cards of one or more typical fifty-two card Poker decks, the cards having associated even or odd values, and at least two of the cards having different associated color values;

each player placing an initial wager to participate in the game;

dealing two cards to each player and three cards to a dealer display card area;

giving each player an opportunity to examine the two cards received by that player;

each player discarding one card and holding one card of the two cards received by the respective player;

giving each player an option to increase their respective initial wager;

revealing one card of the three cards in the dealer display card area;

giving each player an option to forfeit a part of their initial wager;

revealing the remaining two cards in the dealer display card area and selecting a single dealer match card from said revealed cards in the dealer display card area; and resolving each players wager which was not forfeited based on whether the associated color value and associated even or odd value of that players hold card matches the associated color value and associated even or odd value of the dealer's single match card.

20. The method according to claim 19, wherein a players two dealt cards are both winning match cards by same color value of red or black.

21. The method according to claim 19, wherein a players two dealt cards are both winning match cards by same odd or even value given to said cards numerical rank.

22. A method of playing a wagering card game for a number of players, comprising the steps of:

providing a plurality of lower numerical ranking cards of one or more typical fifty-two card Poker decks;

each player placing an initial wager to participate in the game;

dealing two cards face down to each player and three cards face down to a dealer display card area;

giving each player an opportunity to examine their initial two cards received by that player;

each player discarding one card and holding one card of the two cards received by the respective player;

giving each player an option to increase their initial wager by allowing said players to bet an additional amount equal to said wager;

revealing a first card of the three cards dealt in the dealer display card area then giving each player an opportunity to either continue play or to surrender their one card hand whereby one half of the player's wager is forfeited;

revealing the remaining two cards in the dealer display card area;

isolating an odd colored card of the three cards in the dealer display card area, said isolated card constituting a single match card; and resolving each players based on whether the red or black color value and odd or even value of that players held card matches the red or black color value and odd or even value of the single match card the dealer isolated from the dealer display card area.

23. The method according to claim 22, wherein the single match card is placed into a single match card area.

24. The method according to claim 22, wherein odd value cards include any of cards having a numerical value of three, five or seven.

25. The method according to claim 22, wherein even value cards include any of cards having a numerical value of two, four, six or eight.

26. The method according to claim 22, wherein a winning wager comprises a players held card having the same color of red or black as the single match card.

27. The method according to claim 22, wherein a winning wager comprises a players held card having the same value of odd or even as the single match card.

28. The method according to claim 22, wherein a winning card matches in same color all three of the cards in the dealer display card area.

29. The method according to claim 22, wherein a winning card matches in same odd or even value all three of the cards in the dealer display card area.

30. The method of claim 22, further comprising the step of providing a playing surface having a wager receiving area for receiving the initial wager of each player, a player discard area depicted by the word DISCARD for receiving the discarded card from each said player, seven player positions each depicted by an image, a card receiving area for receiving and showing the three dealer display card area cards, and an area for receiving and displaying the single match card.

31. The method of claim 22, further comprising the step of providing a playing surface having a wager receiving area for receiving the initial wager of each player, a player discard area and player match card area depicted by the words DISCARD and MATCH, respectively for receiving the respective discard and match card from each said player, seven player positions each depicted by a an image, a card receiving area for receiving and showing the three dealer display card area cards, and an area for receiving and displaying the single match card depicted by the word MATCH.

* * * * *